US005709561A

United States Patent [19]

Cadoret et al.

[11] Patent Number: 5,709,561

[45] Date of Patent: Jan. 20, 1998

[54] ELECTRICAL CONNECTOR WITH IMPROVED ACUTATION HANDLE

[75] Inventors: Yves Cadoret, Le Mans; Jean-Francois Galipaud, Coulaines, both of France

[73] Assignee: Carrier Kheops Bac S.A., Lemans, France

[21] Appl. No.: 701,685

[22] Filed: Aug. 22, 1996

[51] Int. Cl.[6] ..... H01R 13/62

[52] U.S. Cl. ..... 439/157; 439/144

[58] Field of Search ..... 439/157, 142, 439/144, 310, 372, 152, 153, 155, 159, 160

[56] References Cited

U.S. PATENT DOCUMENTS

| | | | |
|---|---|---|---|
| 1,950,200 | 3/1934 | Tritle | 439/144 |
| 4,544,222 | 10/1985 | Andersson | 439/144 |
| 4,784,610 | 11/1988 | Stuart | 439/144 |

FOREIGN PATENT DOCUMENTS

| | | | |
|---|---|---|---|
| 0 544 630 A2 | 6/1993 | European Pat. Off. . | |
| 959273 | 3/1950 | France . | |
| 974126 | 2/1951 | France . | |
| 0589173 | 12/1933 | Germany | 439/372 |
| 1 145 247 | 3/1963 | Germany . | |
| 2844483 | 5/1979 | Germany | 439/372 |
| 81 01 510.0 | 1/1981 | Germany . | |

*Primary Examiner*—Gary F. Paumen
*Assistant Examiner*—Tho D. Ta
*Attorney, Agent, or Firm*—Cummings & Lockwood

[57] ABSTRACT

This invention concerns an electrical connector of the actuation handle type. This connector has an actuation handle (1) in the shape of a stirrup, mounted articulated on the casing of the fixed element or base (3) of the connector, handle (1) being provided with two inner grooves (25, 23), respectively open toward the top for manipulation of cover (7) and open toward the bottom for the manipulation of plug member (5), and cover (7) and plug member (5) each have two lateral catches (27, 29) cooperating respectively with said grooves (25, 23) for their said manipulation, handle (1) being, moreover, mounted articulated on a flexible axial joint (19) allowing easy passage through a hard point of entrainment of catches (27, 29) on the profile of each of grooves (25, 23) before locking at the end of the course of the grooves, with recall, by placing pressure on cover (7) or plug member (5) respectively in their closed or plugged-in position.

11 Claims, 5 Drawing Sheets

ELECTRICAL CONNECTOR WITH IMPROVED ACUTATION HANDLE

FIELD OF THE INVENTION

The invention concerns an electrical connector with an improved actuation handle and, in particular, a connector whose fixed contact element or base, receiver of the moving contact element or plug member, is provided with an actuation handle, mounted articulated on its body crosswise to the direction of plugging in, said handle being able to actuate, on the one hand, the opening and locked closing of a cover which places the opening of said connector base in the out-of-service position and, on the other hand, the automatic plugging and unplugging of the moving contact element or plug member.

Such a connector, in addition to the fact that it allows an effortless plugging and unplugging due to the action of the handle, permits putting closing pressure of the cover upon closing, which is helpful for sealing the closure and, moreover, allows a positive connection action of the connector contacts, also by placing pressure on the contacts while coupling them to one another.

BACKGROUND OF THE INVENTION

An electrical connector device is known, whose base casing is provided with a closing cover articulated at the periphery of its plug-in opening and which is provided with an actuation handle acting on the cover or the plug member of the complementary connector to lock them respectively either in an out-of-service or a connection position; the articulated handle crosswise to the plugging-in direction has a rear hooking element, roughly in its median section, which is wedged in the low position of the handle, depending on the case, on the outer wall of the closed cover or on the rear wall of the plug member.

Such a device does not assure automatic plugging and unplugging of the connector pin, which may be necessary for large and heavy electrical connectors whose handling requires a significant force for release or engagement.

The object of the invention is to improve the connector device of this type, i.e., which is provided with an articulated actuation handle at the base and acts on the base cover and on the complementary plug member.

SUMMARY OF THE INVENTION

The electrical connector according to the invention is characterized, in fact, in that it has an actuation handle with a stirrup shape, mounted articulated on the casing of the fixed element or base of the connector, crosswise to the plugging-in direction of the complementary moving element or plug member of the connector, the handle being provided on each of its lateral branches, attached to the central core for catching hold and moving freely from one side to the other of the body of the base, with two internal grooves, one of which is open toward the top for manipulating the cover and one of which is open toward the bottom for manipulating the pin, and the cover and the pin each have two lateral catches respectively cooperating with said grooves for their manipulation, said grooves each being provided with a cam-effect profile suitable for receiving, guiding, entraining and locking the catches of the cover or the pin during actuation of the handle. Moreover, the handle is mounted articulated on a flexible axial joint allowing the easy passage past a hard entrainment point of the catches on the profile of each of the grooves before being placed in locked position at the end of the course of the grooves, and with recall, by placing pressure on the cover or the plug member respectively in its closed or plugged-in position.

Naturally, the connector assembly according to the invention has a longitudinal median plane of symmetry (in the plugging-in direction) so as to obtain for the two lateral support points of the catches of the cover or the plug member, a perfectly equilibrated guiding, entraining and locking action of these points in their respective grooves.

The plug member is also bent in the direction opposite the movement of the handle, so as to permit the free movement of the latter for plugging-in.

The grooves of the branches of the handle designed to manipulate the plug member serve, by one side of the profile, for plugging in the moving element, and by the other side, for unplugging this plug member element.

The catches are preferably made in the form of rolling elements, disks or rollers mounted freely rotating in one piece with the cover or the plug member respectively, which facilitates the entrainment manipulation on the grooves and reduces wear, notably upon passage by the hard points of the groove profiles.

The invention is illustrated below by means of an example of embodiment and in reference to the attached drawings, in which:

BRIEF DESCRIPTION OF THE DRAWINGS

FIG. 4 is a longitudinal median sectional view of the connector before the moving contact element or plug member is plugged in.

DETAILED DESCRIPTION

Figure 4:
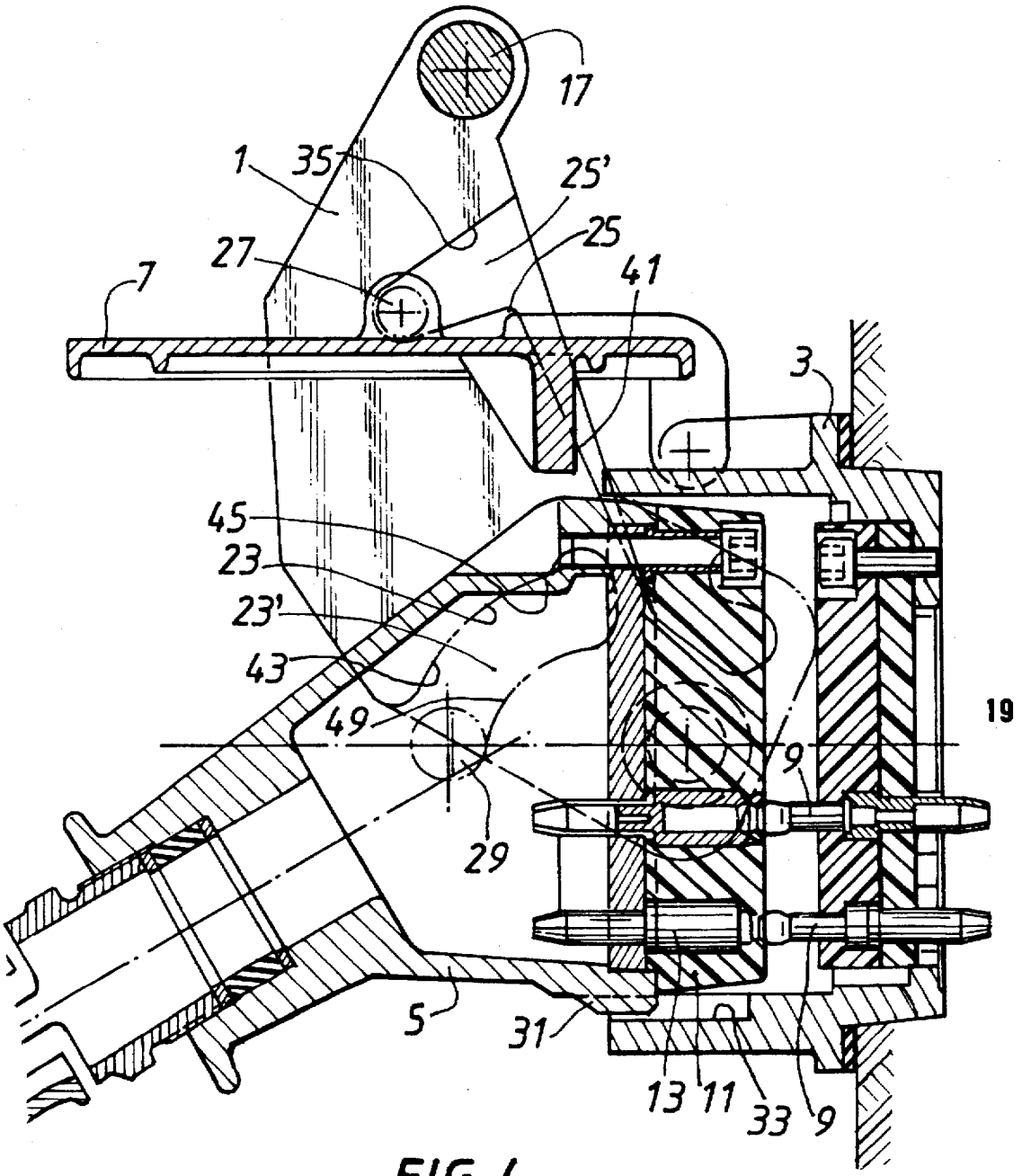

With reference to the drawings and in particular to FIG. 4, the connector according to the invention is of the type with manipulation handle 1, mounted articulated on base 3 of the connector crosswise to the latter and has a moving plug member 5 (FIGS. 4 and 5) complementary to base 3, plugged into the base 3 in the service position of the connector, and a cover 7 also articulated on base 3, at its upper part, closing the base 3 when the connector is in an out-of-service or disconnection position. In FIG. 4, the contact pins 9 are clearly seen, projecting towards the opening of the base 3; these are rigidly held in one piece with the base 3 in a framework of dielectric material 11. Openings 13 complementary to the plug member 5, axially receive contact pins 9 relative to the base 3.

Figure 1:
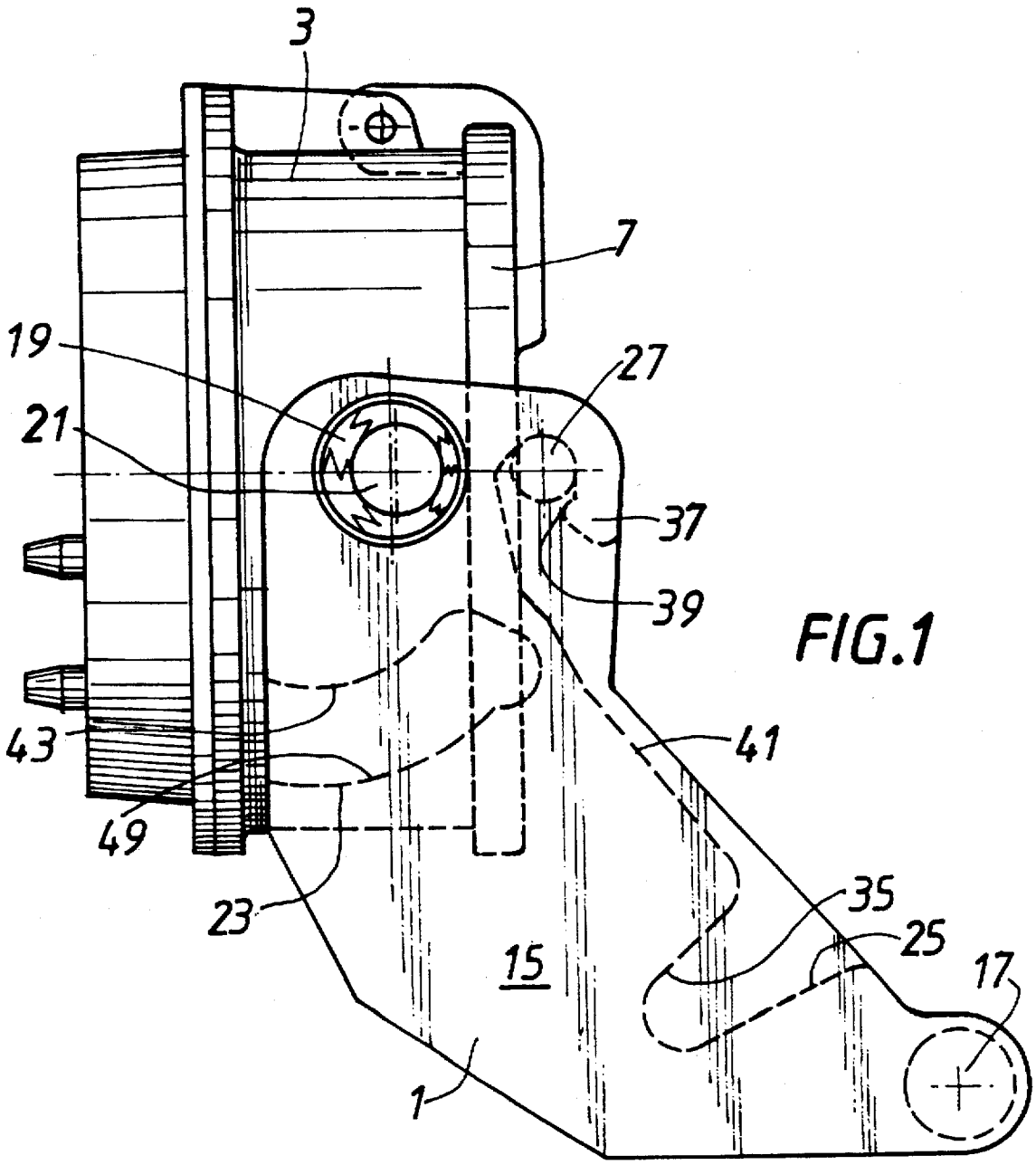
FIG. 1 is a top view of a connector according to the invention without plug member, essentially showing the configuration of the manipulation handle, its articulation and its actuation grooves.

Handle 1 (FIG. 1) is made up of two parallel lateral branches 15 and a central core 17 for catching hold, rigidly coupled to each of branches 15, at their end. It has the general shape of a stirrup with free side-to-side movement of the base 3 and the plug member 5. The handle is articulated laterally on the base 3 by the end of each of its branches 15, opposite core 17 of the handle, at the median level of the base 3 (in an axial plane) and close to its opening. The articulation mounting of the handle 1 is realized by means of flexible bearing joints 19, of elastomer material, attached onto each of the lateral articulation axes 21 of the base 3. This flexible mounting of the handle 1 can also be realized by means of a spring mounting (not shown), for example spiral springs that bring back the lateral articulation bearings of the handle in corresponding openings, or even wound on the handle 1 axes.

Figure 3:
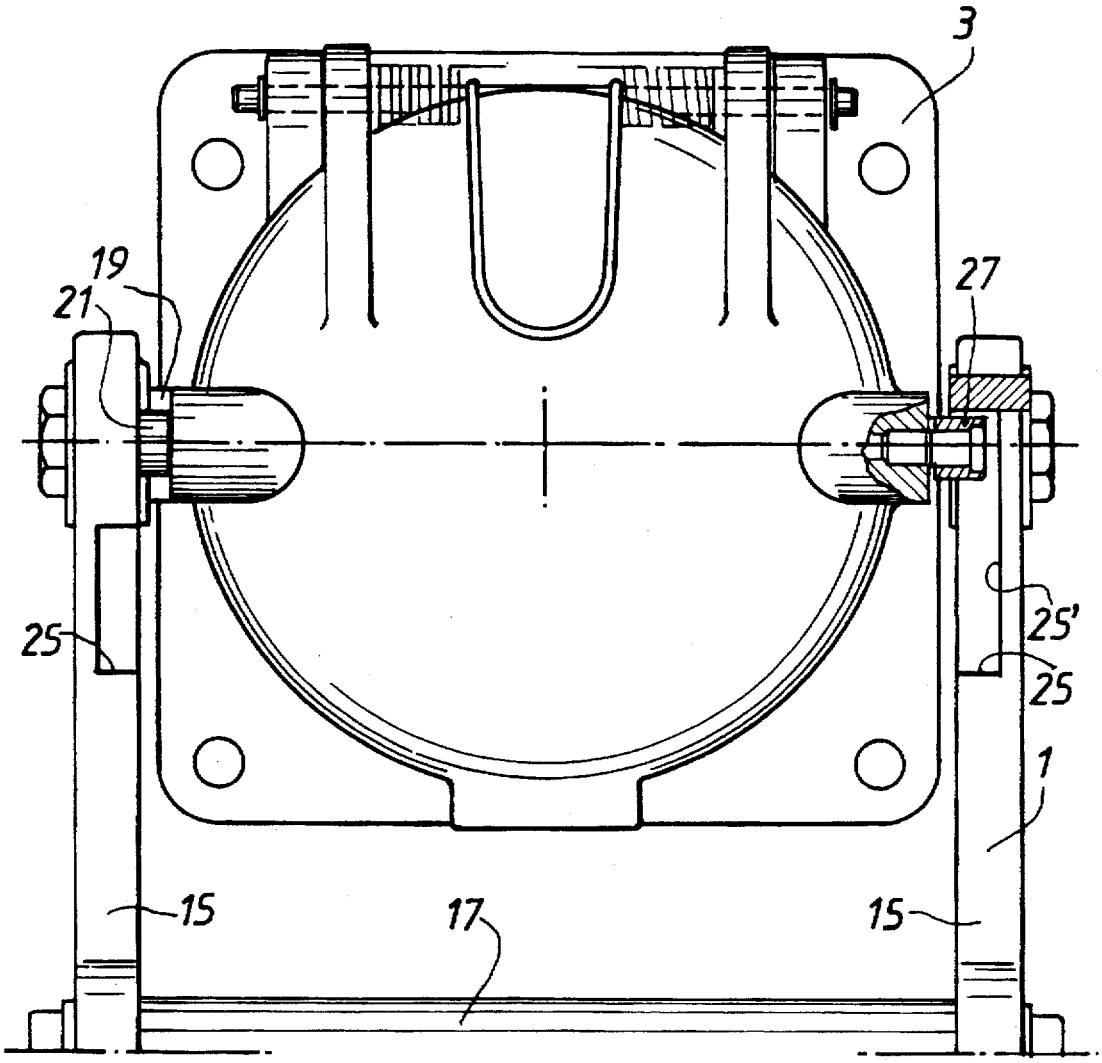
FIG. 3 is a partial sectional view of the cover in closed position.

Each of branches 15 of the handle 1 is provided on its inner surface with two grooves with cam profile, respectively, a groove 23 of the curved form, which extends only slightly at the lower level and is designed for manipulating the plug member 5, and the other groove 25 at the upper level, open toward the top and designed for manipulating the cover 7. These grooves 23, 25 cooperate with lateral rollers 27 (FIG. 3) of the cover, mounted laterally at its median part and moreover, and with roughly identical lateral rollers 29 of the plug member (not shown in cross section due to the similarity with the cover rollers). These grooves 23, 25 are formed in the thickness of the branches of the handle 1, with a lateral planar bottom surface 23', 25' respectively, perpendicular to the axis line of rollers 27 of the cover placed parallel to the articulation axis of the handle 1, and also to the axis line of rollers 29 of the plug member 5 brought into a precise corresponding orientation by a lower guide 31 sliding into a groove 33 of the base (FIG. 4).

Figure 2:
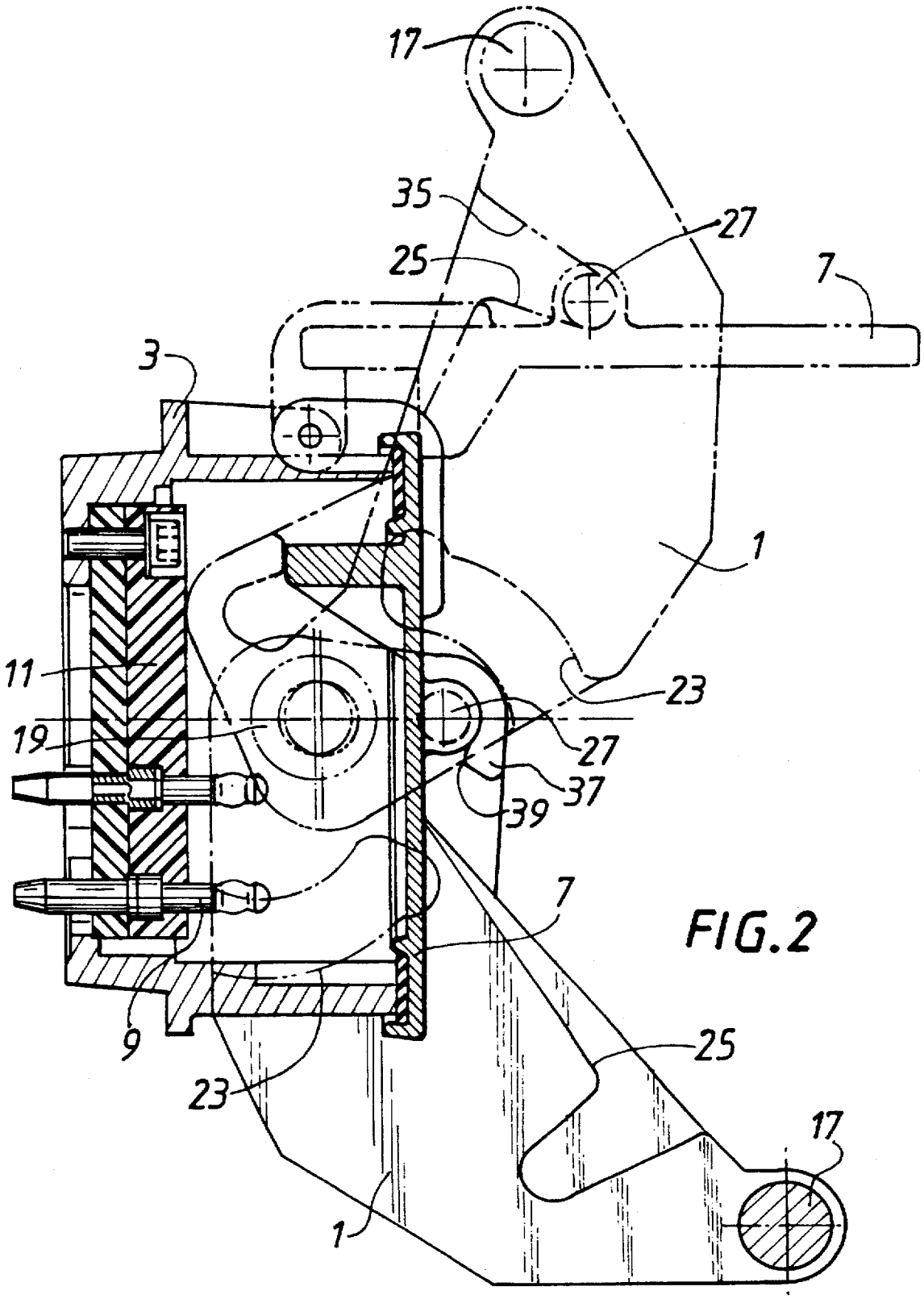
FIG. 2 is a median sectional view of the connector base in closed-cover position, shown by the solid lines, and in open-cover position shown by the dashed lines.

FIG. 2 shows the two extreme positions of opening and closing of the cover 7 of the base 3 in the out-of-service position of the connector. The top position of the handle 1 corresponds to the maximal opening of the cover 7, in which rollers 27 of the cover 7 come to abut the bottom of part 35 tapered toward the bottom of the groove 25 for cover manipulation. The lower representation corresponds to the closed cover position, with handle 7 rotated toward the bottom, in which rollers 27 of the cover are held by the anterior hook-shaped part 37 of the cover manipulation groove, close to the handle articulation. As is most clearly visible in FIG. 1, the end of the hook-shaped part 37 of the groove is provided with an enlarged part 39 for forced passage guiding the rollers on the groove, during manipulation of the handle 1, which constitutes a hard point for the handle manipulation and which holds the handle 1 in stable position pulled by the pressure return action of articulation joint 19 of the handle. In order to open the cover 7, this involves moving the handle 1 toward the top past this hard point where the articulation joint 19 of the handle 1 is pulled under maximum pressure; then rollers 27 of the cover 7 roll onto the linear median portion 41 of the groove, where the articulation joint 19 is then released, until the cover 7 is open, and the pressing of the rollers on the bottom of part of groove 35 is again absorbed, regardless of the shock effect, by the flexible articulation joint 19 of the handle 1.

Figure 5:
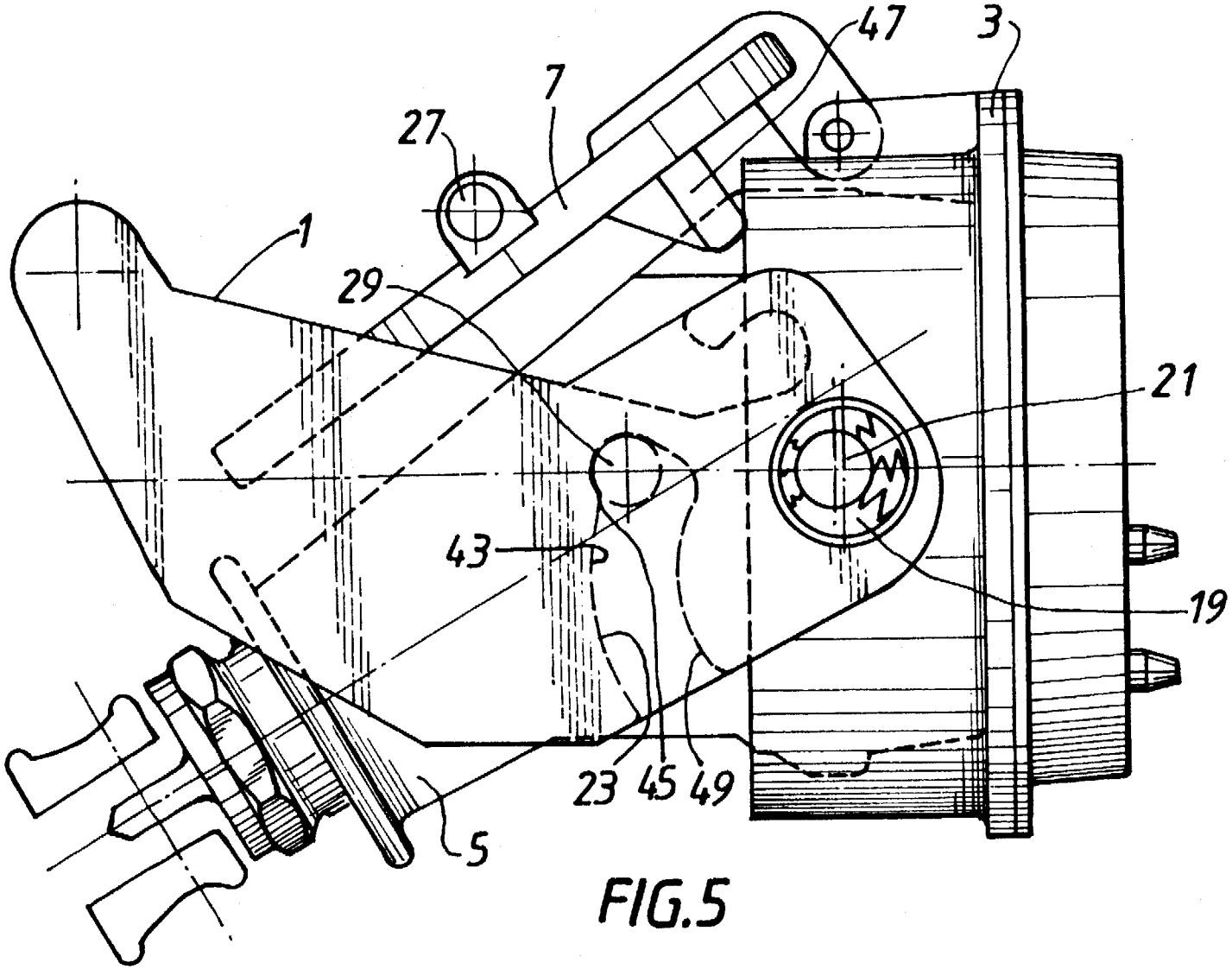
FIG. 5 is a view of the connector in locked position of the plug member.

The plugging and unplugging of the connector plug member 5 are explained in reference to FIGS. 4 and 5, which respectively show, as for the cover 7, the extreme positions, i.e., the positioning of plug member 5 in its base 3 before plugging in and the plugged-in locked position of electrical connection of the connector.

The plugging position of FIG. 4 is that for which the handle 1 is rotated toward the top, cover 7 being held at maximal opening (horizontally) by means of the handle 1 held by one hand of the operator who, with the other hand, positions the, plug member 5 on the base 3 in the correct angular orientation relative to the latter, guide 31 [being inserted] in complementary recess 33 of the base. Rollers 29 of the plug member 5 come from each side of branches 15, each into the opening of groove 23 for manipulation of the plug member. The operator can now rotate the handle 1 toward the bottom and in this movement the rollers 29 come to roll on the top profile surface of the groove and by entraining the pin plug member 5 toward the bottom, this plug member is guided axially by its periphery into the base opening and on groove 33. At a level close to the bottom of the groove 33, which constitutes the locked connection position, the rollers pass simultaneously, due to the symmetry of the configuration relative to an axial median plane for equilibrium of forces, through a top point 45 of the groove profile, or hard point, where each of the lateral articulation joints 19 of the handle is pulled at maximum pressure, to return to the end of course at the bottom of the groove where joints 19 are pulled less strongly. This position is stable, constantly held locked on this side short of the hard point by the elasticity of the lateral articulation joints of the handle. In this position, an additional mechanical locking is realized by the cover, which is supported by an inner tab 47 hooked onto the rear surface of the body of the plug member 5. The contact pins are thus held under pressure inside the openings of the plug member 5 under the pull of the articulation joints of the handle 1, which thus assures a positive connection and guarantees the security of the contact and the electrical coupling obtained thereby.

Withdrawal of the plug member 5 is also obtained automatically by manipulation of the handle, which is rotated toward the top by the operator. Rollers 29 then run along the opposite side 49 of the groove profile relative to the plug member 5, while they pull the pin progressively from its base 3. At the end of the upward rotation of the handle 1, one arrives back at the position indicated in FIG. 4 where the plug member 5 can be completely extracted. It is sufficient to again rotate the handle 1 toward the bottom to close the cover on the base opening in the out-of-service position of the connector.

It will be noted that the connector according to the invention can be the object of numerous variations of embodiment, with regard to the shape of the handle 1, the cam-effect grooves 23, 25 for the plug member 5 or the cover 7, the groove 25 for the cover 7 also being able to be in the curved linear form as for the pin groove 23, with regard to the position of the handle 1 articulation axis on the base 3, the flexible mounting of this articulation axis, etc., within the scope of the attached claims.

We claim:

1. An electrical connector comprising:

a base for receiving a complementary plug member, said base having a housing and a central axis, said plug member having two lateral catches, an out-of-service position and a connection position;

a cover for said base, said cover having two lateral catches, an open position and a closed position;

an actuation handle mounted articulated on a flexible axial joint on the housing of said base crosswise to said central axis, said handle comprising:

a first pair of grooves in said handle for manipulation of said two lateral catches on said cover, said first pair of grooves having a first cam-effect profile for receiving, guiding, and entraining said lateral catches of said cover during actuation of said handle, said first cam-effect profile having near the end of each of said first pair of grooves, a first hard point of entrainment of said catches over which locking is obtained in said closed position applying pressure on the cover upon recall of said flexible axial joint, and;

a second pair of grooves in said handle for manipulation of said two lateral catches on said plug member, said second pair of grooves having a second cam-effect profile for receiving, guiding, and entraining said lateral catches of said plug member during actuation of said handle, said second cam-effect profile having near the end of each of said second pair of grooves, a second hard point of entrainment of said catches over which locking is obtained in said connection position applying pressure on the plug member upon recall of the flexible axial joint.

2. The electrical connector according to claim 1, wherein said handle is generally in the form of a stirrup.

3. The electrical connector according to claim 1, wherein said handle has a median longitudinal plane of symmetry in the plugging-in direction so as to obtain an equilibrated action of guiding, entrainment and locking on said two lateral catches of said cover or said plug member.

4. The electrical connector according to claim 1, wherein said plug member is bent in the direction opposite to the manipulation of said handle to permit the free movement of said plug member for plugging in.

5. The electrical connector according to claim 1, wherein said second pair of grooves for manipulation of said plug member have a first profile for the plugging-in of said plug member and a second profile for withdrawing said pin.

6. The electrical connector according to claim 1, wherein said lateral catches are preferably made of rolling elements mounted rotating freely in one piece with said cover or said plug member, which facilitates the entrainment manipulation on said first and second pairs of grooves by reducing friction.

7. The electrical connector according to claim 1, wherein said handle is flexibly mounted on said base by means of springs.

8. The electrical connector according to claim 1, wherein said plug member is introduced in a given angular orientation into an opening in said base, permitted by the sliding of a guide element of the plug member in a complementary groove of the base.

9. The electrical connector according to claim 1, wherein said cover is held open in the connection position by said handle and said handle continues applying said pressure on said plug member until said handle is locked on the rear body of said pin, upon connection of said plug member.

10. The electrical connector according to claim 1, wherein said first pair of grooves for manipulation of said cover is provided with an anterior hook part having an enlarged end part constituting a hard point for guiding said catches of said cover into said closed position.

11. The electrical connector according to claim 10, wherein said first pair of grooves for said cover manipulation are provided with a part tapered toward a base opposite said anterior hook part for receiving and stopping said lateral catches of the cover upon complete opening of said cover.

* * * * *